US006162078A

United States Patent [19]

Chung

[11] Patent Number: 6,162,078

[45] Date of Patent: Dec. 19, 2000

[54] SOCKET FOR AUTOMATICALLY SWITCHING CIRCUITRY

[75] Inventor: Chang-Yu Chung, Taipei Hsien, Taiwan

[73] Assignee: ATEN International Co., Ltd., Taiwan

[21] Appl. No.: 09/487,618

[22] Filed: Jan. 20, 2000

[51] Int. Cl.[7] ..... H01R 29/00

[52] U.S. Cl. ..... 439/188; 200/51.1

[58] Field of Search ..... 439/188; 200/51.1, 200/51.05, 51.09, 535, 60

[56] References Cited

U.S. PATENT DOCUMENTS

| | | | |
|---|---|---|---|
| 4,380,691 | 4/1983 | Sato | 200/61.58 R |
| 5,927,999 | 7/1999 | Shimojyo | 439/63 |
| 6,030,240 | 7/1999 | Duff | 439/188 |

*Primary Examiner*—Brian Sircus
*Assistant Examiner*—Son V. Nguyen
*Attorney, Agent, or Firm*—McDermott, Will & Emery

[57] ABSTRACT

A socket for automatically switching circuitry comprises an insulating housing, first contact, second contact, transmission component, and slave switch. The insulating housing has an opening for allowing the plug to insert into this opening. The first contact fixed on an inner side of the housing mechanically and electrically connects with a first electrode of the plug. The second contact with flexibility fixed in the housing mechanically and electrically connects with a second electrode of the plug and responds to the insertion of the plug to generate a deflection. A transmission component touching with the second contact transmits the deflection as a shifting displacement. The slave switch is separated from the second contact by touching with the transmission component at an opposite side to the second contact. When the plug inserts into the socket, the slave switch automatically switches the circuitry on or off by responding to the shifting displacement of the transmission component.

16 Claims, 3 Drawing Sheets

SOCKET FOR AUTOMATICALLY SWITCHING CIRCUITRY

FIELD OF THE INVENTION

This invention relates to a socket, and more particularly to a socket with a salve switch for automatically turning on and off a circuit in accordance with the insertion of a plug into the socket.

BACKGROUND OF THE INVENTION

Universal serial bus (USB), a new I/O standard promoted by main computer industrials, has been widely accepted by computer market. Since the USB port unifies many traditional I/O ports, such as serial ports, parallel ports, and PS/2 ports, into a single specification, it simplifies the usage of I/O ports. According to the specification, the USB port includes four wires, in which two wires convey digital information from port to port. The other two wires of USB port transmit electric power to drive peripheral devices connected thereon. For expanding the number of peripheral devices communicating with USB ports, many USB hubs may couple together to a host root hub, namely a computer, to build up a Tier-Star connection.

Typically, the USB hub includes at least a USB port and a direct current (DC) socket. In bus power mode, the host root hub transmits electric power through the two power lines of the USB port to drive the USB hub. Similarly, the USB hub transmits electric power to drive peripheral devices connected with it In the present USB specification, the two power lines of USB port only convey electric current in about 100 mA. For some low power-consuming devices, this electric current is sufficient. However, for some high power-consuming devices, this electric current would not be able to drive them. In the cases of high power-consuming devices, the USB hub must be operated in external power mode by importing electric power through the DC socket. Thus, by selectively employing the USB port and DC socket, the USB hub would always drives the peripheral devices connected thereon.

FIG. 1 shows a cross-sectional view of a conventional DC socket 10. The DC socket 10 includes a first contact 14 shaped from a pillar and a second contact 18 shaped from a bending reed. When the plug 6 inserts into the DC socket 10, its conductive tube 8 mechanically and electrically connects with the first contact 14 by fitting around it. Meanwhile, the second contact 18 also mechanically touches and electrically connects with the outer surface of the conductive tube 8. Thus, the plug 6 transmits external electrical power to any devices containing the socket 10.

Although the USB hub receives electric power selectively from the USB port or DC socket, it exits a problem of electrical interference, which is due to using the USB port and DC socket at the same time. When the electrical interference happens, the USB hub has no schemes to distinguish the two power modes, so that some errors or even more serious damages may happen. Therefore, there is a huge need to prevent the USB hub from occurring the electrical interference.

SUMMARY OF THE INVENTION

An objective of this invention is to provide a socket with a slave switch, which responds to insertion of a plug to automatically turn on or off a circuit connecting with the slave switch.

A socket for automatically switching circuitry comprises a housing, first contact, second contact, transmission component, and slave switch. The housing, which is made of insulating materials, forms an opening a plug may inserts in. The first contact and are fixed on inner sides of the housing. When the plug inserts into the socket, its first electrode and second electrode electrically connects with the first contact and second contact, respectively. Because the second contact has a flexible shape, it responds to the insertion to deflect. The transmission component, which touches with the second contact, transmits the deflection to push the slave switch, which connects with the transmission component at an opposite side to the second contact. Therefore, the slave switch turns on or off any circuits connecting with it.

DETAILED DESCRIPTION OF THE PREFERRED EMBODIMENT

The present socket employs a salve switch, which responds to insertion of the socket with a plug to automatically switch on or off a circuit, which exists together with the socket in electronic devices. Typically, the socket has two contacts for electrically connecting with two electrodes of any plugs. One of the two contacts is able to deflect as a result of its flexible shape. A transmission component sandwiches in the flexible contact and the slave switch. When a plug inserts into the socket causing a deflection to the flexible contact, the transmission component transmits the deflection and thus turns the slave switch on or off. Although the socket widens design flexibility for many electronic devices, it particularly facilitates USB devices, such as USB hubs and USB connectors. Because the USB devices import electric power by either their USB ports or DC sockets, electrical interference may happen, when using the USB ports and DC sockets imports electric power at the same time. By employing the present socket in a USB device and coupling the socket's salve switch with power lines of its USB port, the socket automatically switches off the power lines when a plug inserts into it, thereby avoiding the electrical interference. For clearly illustrating the spirit of this invention, three embodiments are described in following paragraphs.

Figure 1:
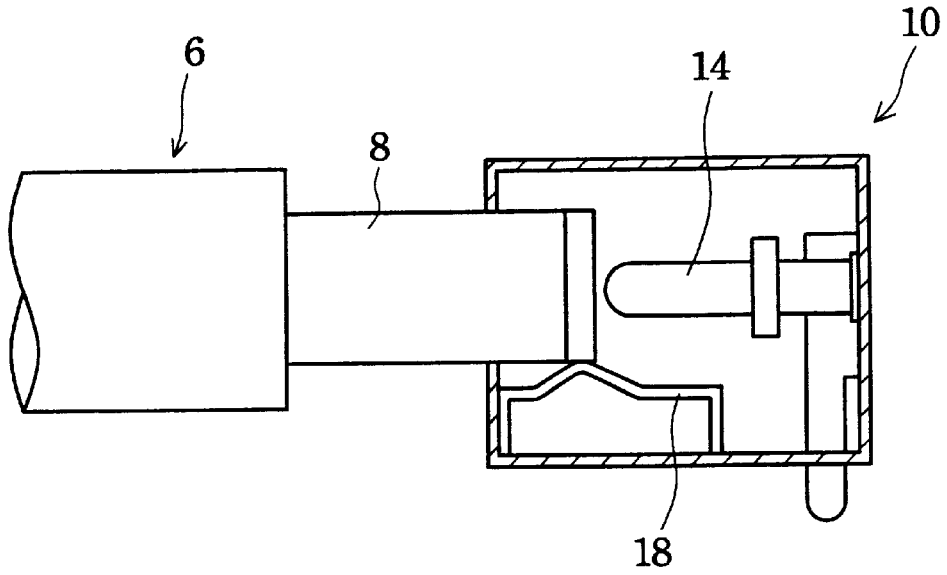
Figure 1 (Prior Art)
FIG. 1 is a cross-sectional view of a conventional direct current socket.
Figure 2:
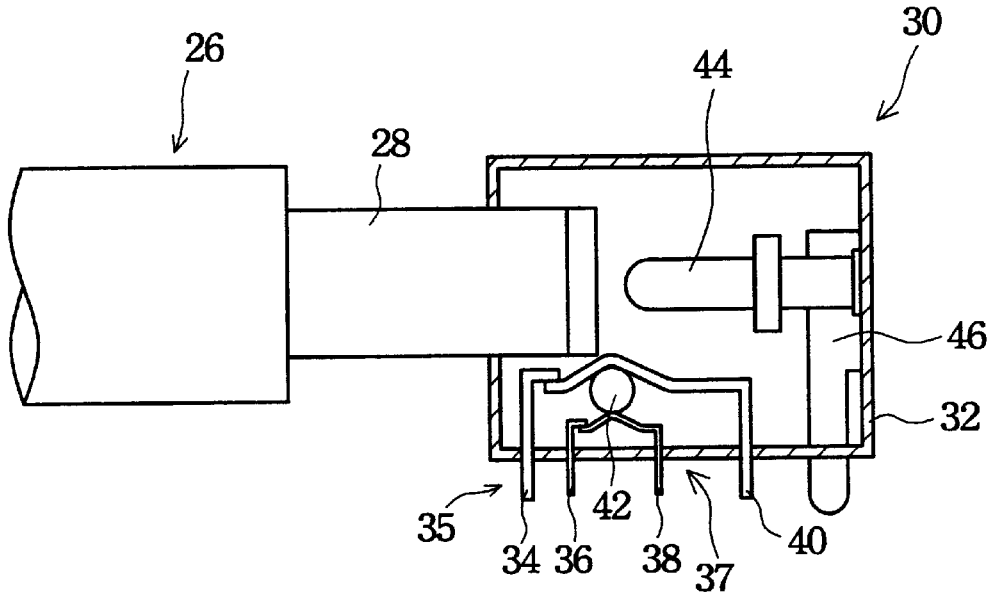
FIG. 2 is a cross-sectional of a present socket, which has not yet been inserted by a plug, in accordance with the first embodiment of this invention.
Figure 3:
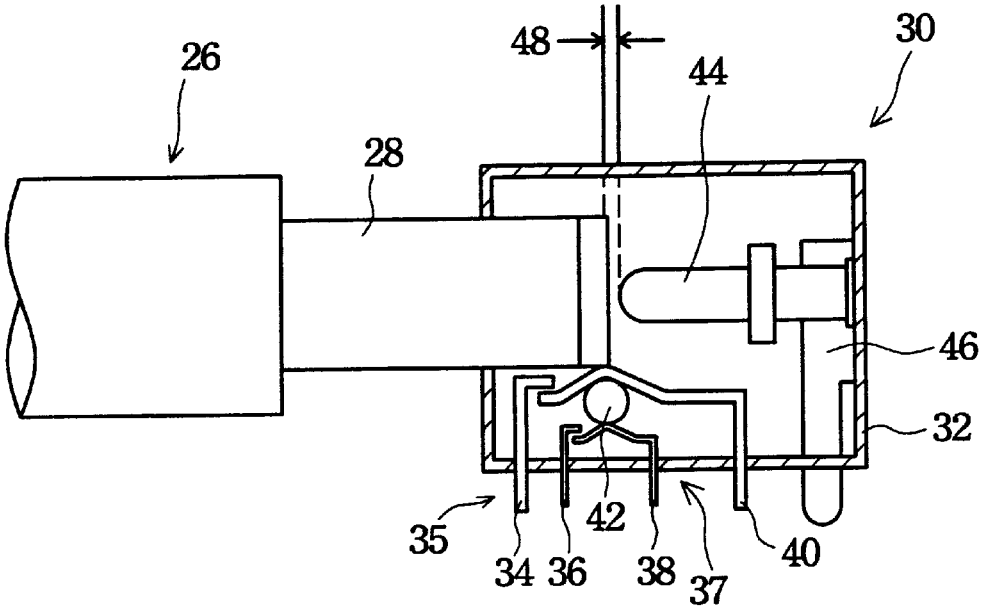
FIG. 3 is a cross-sectional of the present socket, which has been inserted by a plug, in accordance with the first embodiment of this invention.

FIG. 2 and FIG. 3 illustrate cross-sectional views of a socket 30 of the first embodiment according to this invention. Referring to FIG. 2, the socket 30 includes a housing 32, first contact 44, second contact 35, transmission component 42, and slave switch 37. The first contact 44, which is made of conductive material and shaped as a pillar, is fixed on an inner side of the housing 32 and electrically connects with a metal sheet 46. The second contact 35 includes of the first reed 34 and second reed 40. When a plug 26 inserts into the socket 30, the first contact 44 fits into the inner surface, the first electrode of the plug 26 for transmitting current, of the conductive tube 28, so as to form a mechanical and electrical connection between them. Meanwhile, the outer surface, the second electrode of the plug 26, touches with the second contact 35, more specifically the second reed 40, forming an electrical connection. Therefore, the plug 26 conveys electric power through the first contact 44, metal sheet 46, and second contact 35 into any devices adopting the socket 30. It's noticed that the socket could be modified to receive a uniaxial plug or dualaxial plug depending on various applications.

Still referring to FIG. 2, a transmission component 42, such as an insulating ball and an insulating pillar, separates the second contact 35 from the slave switch 37. Since the second reed 40 has a bending shape in its top portion, the transmission component 42 would rest in a fixed position and keep in connection with the second reed 40 and fourth reed 38. As shown in this figure, the outer surface of the conductive tube 28 doesn't touch with the second contact 35, more specifically the second reed, so that the second reed 40 connects to the first reed 34 denoting a normal close state. Likewise, the third reed 36 connects with the fourth reed 38, therefore, also denoting a normal close state.

FIG. 3 shows that the plug 26 inserts into the socket 30 causing downward deflections of the second reed 40 and fourth reed 38, which separate the forth reed 37 from the third reed 36, thereby turning off the slave switch 37. As a result of the insertion of the plug 26, the outer surface touches with the second reed 40 and causes it to deflect downwardly. Because the transmission component 42 will not deform while pushed by second reed 40, it transmits the deflection into a displacement to push the fourth reed 38 moving downwardly. In other words, the salve switch 37 responds to the insertion of the plug 26 to turn off any circuits connecting to it. For instance, a USB device employs the socket 30 and couples two power lines of its USB port with the slave switch 37. If the USB device imports electric power through the socket, because of the insertion of the plug 26, the slave switch 37 will turn off the power lines, thereby preventing the undesired electrical interference, which happens when the socket 30 and power lines of USB port import electric power at the same time. It's noticed that the touching point of the conductive tube 28 and the second reed 40 leads a length 48 over that of the first contact 44. Thus, the plug 26 always activates the slave switch 37 before fully connecting with the socket 30 by its two electrodes. AS for the USB device, by adopting such a design, the slave switch 37 suspends the power lines of USB port before the socket 30 is available to import electric power.

Figure 4:
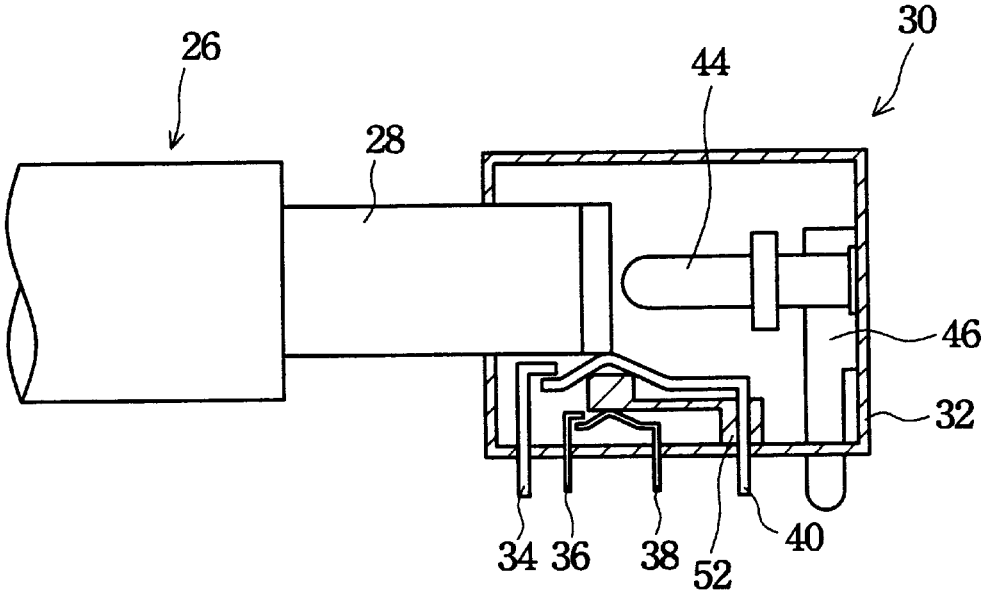
FIG. 4 is a cross-sectional of the present socket, which has been inserted by a plug, in accordance with the second embodiment of this invention.

FIG. 4 shows a cross-sectional view of the socket 30 of the second embodiment. Because the main structure of the socket 30 is similar with that in the first embodiment, the follows do not illustrate in detail. The most distinguish feature in this embodiment is employing an insulating cantilever beam 52 as the transmission component. At the end of the insulating cantilever beam 52, a protrusion separates the second reed 40 from the fourth reed 38. Likewise, when the plug 26 inserts into the socket 30, the insulating cantilever beam 52 transmits the downward deflection of the second reed 40 to push the fourth reed 38, thereby breaking the connection of the third reed 36 and fourth reed 38.

Figure 5:
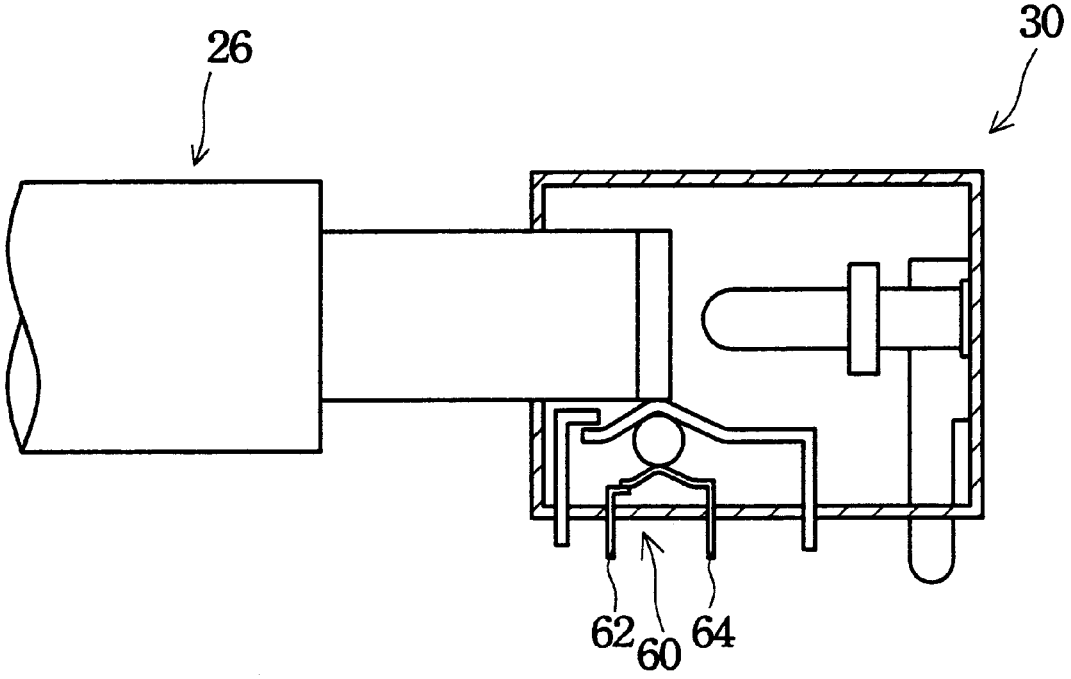
FIG. 5 is a cross-sectional of the present socket, which has been inserted by a plug, in accordance with the third embodiment of this invention.

FIG. 5 shows a cross-sectional view of the socket 30 of the third embodiment. Because the main structure of the socket 30 is similar with that in the foregoing embodiments, the follows do not illustrate in detail. The most distinguish feature in this embodiment is setting the forth reed 64 above the third reed 62. In a normal state, namely the socket 30 without the insertion of the plug 26, the forth reed 64 separates from the third reed 62. In other words, the slave switch 60 is in a normal open state. When the plug 26 inserts into the socket 30, the fourth reed 64 deflects downwardly to connect with the third reed 62, thereby turning on the circuit connecting thereon. In this embodiment, the slave switch 60, a normal open switch different from the foregoing embodiments, expands the flexibility of its applications.

Finally, it should be understand that the number of slave switch of the socket doesn't fall into one. For persons skill in the art may easily expand the number of slave switch by stacking it with the transmission component, and the number should depend on real needs.

As is understood by a person skilled in the art, the foregoing preferred embodiments of the present invention that are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A socket for automatically switching circuitry by responding to insertion of a plug into the socket, which comprises:

an insulating housing having an opening for allowing the plug to insert into the opening;

a first contact fixed on an inner side of the housing for mechanically and electrically connecting with a first electrode of the plug;

a second contact with flexibility fixed in the housing for mechanically and electrically connecting with a second electrode of the plug and responding to the insertion of the plug to generate a deflection;

a transmission component touching with the second contact for transmitting the deflection as a shifting displacement; and a slave switch separated from the second contact by touching with the transmission component at an opposite side to the second contact, when the plug inserts into the socket, the slave switch automatically switching the circuitry on or off by responding to the shifting displacement of the transmission component.

2. The socket of claim 1, wherein the circuitry is a power importing circuit, which introduces electric power from a universal serial bus port, of a universal serial bus apparatus, when the plug inserts into the socket for introducing electric power from an external power resource, the slave switch suspending the power importing circuit, thereby avoiding an electrical interference between uses of the universal serial bus port and the socket.

3. The socket of claim 1, wherein the plug comprises a uniaxial plug and a dualaxial plug.

4. The socket of claim 1, wherein the first contact is a pillar electrode fixing concentric with the opening of the housing.

5. The socket of claim 1, wherein the second contact comprises a first reed stretching from a surface of the housing into the opening and a second reed bending from the surface into the opening to touch with first reed, when the plug inserts into the socket, the second reed deflecting downwardly to separate from touching with the first reed.

6. The socket of claim 1, wherein the transmission component is an insulating ball or an insulating pillar.

7. The socket of claim 1, wherein the transmission component is a cantilever beam with a protrusion at an end of the cantilever beam for separating the second contact from the slave switch.

8. The socket of claim 1, wherein the slave switch comprises a third reed and a fourth reed, which is separating from the second reed by the transmission component, when the plug stays out of the socket, the fourth reed touching with the third reed, when the plug inserts into the socket, the fourth reed responding to the displacement of the transmission component to deflect downwardly thereby separating from touching with the third reed.

9. The socket of claim 1, when the plug inserts in the socket, the second contact touching to the plug before the first contact does, thereby ensuring the slave switch to be activated before the first electrode of the plug electrically connecting with the first contact.

10. A socket of a universal serial bus apparatus for introducing external electric power into the universal serial bus apparatus, which further has a universal serial bus port for receiving electric power, the socket comprising:

an insulating housing having an opening for allowing the plug to insert into the opening;

a first contact pillar fixed on an inner side of the housing for mechanically and electrically connecting with a first electrode of the plug;

a second flexible contact fixed in the housing for mechanically and electrically connecting with a second electrode of the plug and responding to the insertion of the plug to generate a deflection;

a transmission component touching with the second contact for transmitting the deflection as a shifting displacement; and a slave switch separated from the second contact by touching with the transmission component at an opposite side to the second contact, when the plug inserts into the socket, the slave switch automatically switching off a circuit connecting with the universal serial bus port of receiving electric power for the universal serial bus apparatus, thereby avoiding an electrical interference of mixing uses of the universal serial bus port and the socket.

11. The socket of claim 10, wherein the plug belongs to an adapter.

12. The socket of claim 10, wherein the second flexible contact comprises a first reed stretching from a surface of the housing into the opening and a second reed bending from the surface into the opening to touch with first reed, when the plug inserts into the socket, the second reed deflecting downwardly to separate from touching with the first reed.

13. The socket of claim 10, wherein the transmission component is an insulating ball or an insulating pillar.

14. The socket of claim 10, wherein the transmission component is a cantilever beam with a protrusion at an end of the cantilever beam for separating the second flexible contact from the slave switch.

15. The socket of claim 10, wherein the slave switch comprises a third reed and a fourth reed, which is separating from the second reed by the transmission component, when the plug stays out of the socket, the fourth reed touching with the third reed, when the plug inserts into the socket, the fourth reed responding to the displacement of the transmission component to deflect downwardly thereby separating from touching with the third reed.

16. The socket of claim 10, when the plug inserts in the socket, the second flexible contact touching to the plug before the first pillar contact does, thereby ensuring the slave switch to be activated before the first electrode of the plug electrically connecting with the first pillar contact.

* * * * *